US008011355B2

(12) United States Patent
Kawashima

(10) Patent No.: US 8,011,355 B2
(45) Date of Patent: Sep. 6, 2011

(54) CARTRIDGE-BASED AIR GUN

(75) Inventor: Hiroshi Kawashima, Saitama-ken (JP)

(73) Assignee: Marushinkogyo Kabushikikaisha, Saitama-Ken (JP)

( * ) Notice: Subject to any disclaimer, the term of this patent is extended or adjusted under 35 U.S.C. 154(b) by 0 days.

(21) Appl. No.: 12/795,044

(22) Filed: Jun. 7, 2010

(65) Prior Publication Data

US 2011/0083653 A1 Apr. 14, 2011

(30) Foreign Application Priority Data

Oct. 14, 2009 (JP) ..... 2009-237530

(51) Int. Cl.
*F41B 11/00* (2006.01)

(52) U.S. Cl. ..... 124/57; 124/74

(58) Field of Classification Search ..... 124/45, 124/51.1, 52, 71–77; 42/17, 18, 21, 22, 25, 42/46, 49.01

See application file for complete search history.

(56) References Cited

U.S. PATENT DOCUMENTS

| | | | | | |
|---|---|---|---|---|---|
| 2,098,068 | A | * | 11/1937 | Skinner | 102/444 |
| 2,136,396 | A | * | 11/1938 | Savage | 42/75.04 |
| 2,377,703 | A | * | 6/1945 | Loomis | 42/22 |
| 3,205,604 | A | * | 9/1965 | Plumer | 42/50 |
| 4,031,648 | A | * | 6/1977 | Thomas | 42/70.02 |
| 4,103,587 | A | * | 8/1978 | Vanek | 89/175 |
| 4,155,187 | A | * | 5/1979 | Lichtman | 42/11 |
| 4,539,969 | A | * | 9/1985 | Saxby | 124/57 |
| 5,678,340 | A | * | 10/1997 | Moon | 42/25 |
| 6,212,991 | B1 | * | 4/2001 | Frazier, III | 89/196 |
| 7,322,143 | B2 | * | 1/2008 | Rohrbaugh et al. | 42/71.02 |
| 7,353,815 | B2 | * | 4/2008 | Wei | 124/45 |
| 2001/0027786 | A1 | * | 10/2001 | Kunimoto | 124/73 |
| 2003/0047174 | A1 | * | 3/2003 | Tiberius et al. | 124/74 |
| 2004/0159033 | A1 | * | 8/2004 | Rohrbaugh | 42/69.03 |
| 2006/0185212 | A1 | * | 8/2006 | Curry et al. | 42/46 |
| 2006/0201491 | A1 | * | 9/2006 | Wei | 124/74 |

FOREIGN PATENT DOCUMENTS

| | | | | |
|---|---|---|---|---|
| JP | 62-280593 | | | 12/1987 |
| JP | 02-054088 | | | 4/1990 |
| JP | 03-046787 | | | 4/1991 |
| JP | 03-079092 | | | 8/1991 |
| JP | 3051479 | | | 6/1998 |
| JP | 2004-190876 | | | 7/2004 |
| JP | 2009-145003 | | | 4/2009 |
| JP | 2010048522 | A | * | 3/2010 |
| JP | 2010121923 | A | * | 6/2010 |

* cited by examiner

*Primary Examiner* — Troy Chambers
(74) *Attorney, Agent, or Firm* — Young & Thompson

(57) ABSTRACT

A cartridge-based air gun that fires a BB bullet or a resin bullet inside a cartridge using compressed gas, includes an engaging structure of an extractor that enables blowback and the automatic ejection of the cartridge. An extractor, which engages with a rim that is formed at the rear end of a cartridge loaded in a chamber, is pivotally provided on a side portion of a cylinder so as to be rotatable. A claw portion formed at the tip of the extractor engages with the rim of the cartridge by the urging force of a spring provided between the extractor and the cylinder. A slide moves rearward while the cartridge is held inside the chamber. As the cylinder moves rearward with the stopping of the supply of compressed gas from a gas reservoir, the cartridge comes into contact with an ejector, is released from the engagement by the extractor, and is ejected from the chamber.

2 Claims, 8 Drawing Sheets

CARTRIDGE-BASED AIR GUN

BACKGROUND OF THE INVENTION

1. Field of the Invention

The present invention relates to cartridge-based air guns in which after a bullet inside a cartridge has been fired by means of compressed gas, the slide automatically moves forward/rearward, and the spent cartridge is automatically ejected.

2. Background Art

Air guns in which plastic bullets (so-called "BB bullets") or resin bullets are fired by means of compressed gas have conventionally been known. In addition, cartridge-ejecting air guns in which after a bullet loaded in a cartridge has been fired, the slide automatically moves forward/rearward (so-called "blowback") and the spent cartridge can be ejected have been developed.

However, there had yet to be developed an air gun wherein a clip loaded with a plurality of cartridges and a gas reservoir are integrally constructed within a magazine, this magazine is detachably loaded in a magazine chamber in the body of the gun, and the above-mentioned blowback and ejection of the cartridge are performed after a bullet is fired.

As such, and through extensive efforts by the present inventors, the air gun disclosed in Patent Document 1, which meets the above-mentioned structure, was developed.

However, in real automatic guns, bullet-loaded cartridges are loaded in a clip, and the slide either temporarily moves rearward or the slide is pulled by force, thereby propelling the cartridge forward with the elastic force of a compressed spring, and feeding the cartridge into the chamber.

At this point, by having the claw(s) of an extractor latched to the slide engage with the rim of the cartridge, the cartridge is held within the chamber. Subsequently and during a blowback operation in which the slide moves rearward immediately after the bullet is fired, the cartridge is simultaneously made to move rearward, and once it has completed its rearward movement, the cartridge, having come into contact with an ejector, is ejected by a kicking action of the ejector.

However, in the case of toy guns which fire BB bullets or resin bullets within cartridges using compressed gas, it was impossible to eject cartridges with mechanisms similar to those of real guns. This is because when such a structure is adopted where the extractor is latched to the slide as in real guns, a piston attached to the rear portion of the slide is unable to move rearward even if gas is fed to the cylinder. As a result, the slide does not perform a blowback operation, and the cartridge cannot be ejected either.

Accordingly, as in the cartridge-based air gun of Patent Document 1, in the case of toy guns that fire bullets inside cartridges using compressed gas, in order to perform a blowback operation and have cartridges ejected automatically, it is necessary to adopt a structure in which a blowback operation of the slide is enabled by adopting, instead of a structure in which the extractor is latched to the slide, a structure in which the extractor is attached to some other movable part.

[Patent Document 1] JP Patent Publication (Kokai) 2009-145003 A

SUMMARY OF THE INVENTION

The present invention is made in view of the circumstances discussed above, and one of its objects is to provide a cartridge-based air gun that fires BB bullets or resin bullets inside cartridges using compressed gas, the cartridge-based air gun comprising an engaging structure of an extractor that enables performing a blowback operation and automatically ejecting a cartridge after a bullet is fired.

In addition, an object of the present invention is to provide the above-mentioned cartridge-based air gun wherein faster execution of the blowback operation is made possible.

Further, an object of the present invention is to provide the above-mentioned cartridge-based air gun wherein an operation for loading a cartridge from a clip of a magazine to the chamber is performed smoothly and reliably.

In order to solve the problems discussed above, a cartridge-based air gun according to a first aspect of the present invention is a cartridge-based air gun wherein: a clip, which is vertically loaded with plural cartridges that are each horizontally oriented, and a gas reservoir are provided inside a magazine that is provided separately from a body of the gun, and the magazine is detachably loaded in a magazine chamber provided in a grip of the body of the gun; a chamber is provided between a rear end of an inner barrel, which is provided in a barrel of the body of the gun, and a front end of a cylinder, which is so provided as to be movable forward and rearward inside a slide that is capable of moving forward and rearward on an outer circumference of the inner barrel; an uppermost cartridge in the clip in the magazine is loadable to the chamber by being urged by a spring force of a follower spring provided within the clip; each of the plural cartridges is so configured as to hold a bullet in a through-hole provided therein and to be firable forward by compressed gas that is supplied from behind; after the bullet loaded in the cartridge is fired by the compressed gas supplied from the gas reservoir, a spent cartridge is automatically ejected when the slide automatically moves rearward due to the compressed gas that fills the cylinder; an extractor that engages with a rim, which is formed at a rear end of the cartridge loaded in the chamber, is pivotally provided on a side portion of the cylinder so as to be rotatable, and a claw portion formed at a tip of the extractor is able to engage with the rim of the cartridge by means of an urging force of a spring provided between the extractor and the cylinder; and as the slide moves rearward while the cartridge is held inside the chamber and as the cylinder moves rearward with the stopping of the supply of the compressed gas from the gas reservoir, the cartridge comes into contact with the ejector and is ejected from the chamber.

Further, a cartridge-based air gun according to a second aspect of the present invention is a cartridge-based air gun wherein, by providing a gap of at least 1 mm between a rear end of the cylinder and a rubber packing provided on an outer circumference of a front end of a piston, blowback of the slide is performed quickly by discharging at once through the gap the gas that fills the cylinder.

Further, a cartridge-based air gun according to a third aspect of the present invention is the air gun according to the first or second aspect above, wherein: magazine lips that engage with a rear portion of the uppermost cartridge in the clip are provided on both sides at a rear portion of an upper end opening in the clip in the magazine; a notch portion is formed in an upper end of a front wall of a body of the magazine; the notch portion has such a depth that makes it possible for the uppermost cartridge in the clip to move forward; and the magazine lips are formed in such a length that an engaging action with respect to the uppermost cartridge in the clip is released at a position where, having moved forward, a front end of the cartridge is in contact with an inclined guiding surface of a feeding ramp provided at a forward position relative to the magazine.

With the structure of the present invention according to the first aspect above, it is possible to reload the magazine provided separately from the body of the gun with cartridges, and by detachably loading this magazine in the magazine chamber provided in the grip of the body of the gun, while also loading a cartridge in the chamber of the body of the gun, the bullet inside the cartridge can be fired. In addition, by making the slide perform a blowback operation after the bullet is fired, it is also possible to eject the spent cartridge from the chamber.

Further, in the present invention, in order to enable the slide to perform a blowback operation, such a structure is adopted where the extractor, which engages with the rim that is formed at the rear end of the cartridge loaded in the chamber, is pivotally provided on the side portion of the cylinder so as to be rotatable. In addition, this extractor is of such a structure that the claw portion formed at the tip of the extractor is able to reliably engage with the rim of the cartridge by means of the urging force of the spring provided between the extractor and the cylinder.

By having, through such a structure, the extractor latched to the cylinder that is movable relative to the slide, the cartridge loaded in the chamber is, in the blowback operation, held in the chamber in a state where it is engaged by the extractor latched to the cylinder. Further, because the piston attached to the slide is movable, the blowback operation of the slide is also enabled.

In addition, in the above-mentioned blowback operation, as the supplying of the compressed gas from the gas reservoir stops and as the cylinder moves rearward, the cartridge that has come into contact with the ejector is released from the engagement by the extractor and becomes ejectable from the chamber.

Further, with respect to the above-mentioned blowback operation, it had been conventional to provide a gap of about 0.5 mm between the rear end of the cylinder and the rubber packing provided on the outer circumference of the front end of the piston, and to thus discharge from that gap the compressed gas that fills the interior of the cylinder. However, the blowback operation of the slide cannot be performed quickly with a gap of such a size. With a cartridge-based air gun according to the second aspect of the present invention, by providing the gap of at least 1 mm between the rear end of the cylinder and the rubber packing provided on the outer circumference of the front end of the piston, the gas that fills the interior of the cylinder is discharged at once from that gap, thereby expediting the rearward movement time of the cylinder, and making it possible to perform the blowback operation quickly.

Further, in a cartridge-based air gun according to the third aspect of the present invention, by virtue of the fact that the notch portion provided in the upper end of the front wall of the body of the magazine has such a depth that allows for forward movement of the uppermost cartridge in the clip, the uppermost cartridge in the clip moves in the forward direction and it becomes possible to place the front end of the cartridge in contact with the inclined guiding surface of the feeding ramp provided at a forward position relative to the magazine. In addition, the length of the magazine lips is so formed that the engaging action of the magazine lips with respect to the cartridge can be released at the same time as the front end of the cartridge thus comes into contact with the inclined guiding surface of the feeding ramp. Consequently, instead of having the cartridge disengage from the magazine lips in an inclined state, it is possible to have the cartridge hit the ceiling of the chamber in a substantially parallel state, thereby enabling stable loading to the chamber.

DETAILED DESCRIPTION OF THE PREFERRED EMBODIMENTS

An embodiment of the present invention is described below with reference to the drawings. It is noted that the terms "forward" and "rearward" as used herein in describing the present invention respectively refer to the muzzle side and the hammer side of the body of the gun.

Figure 1:
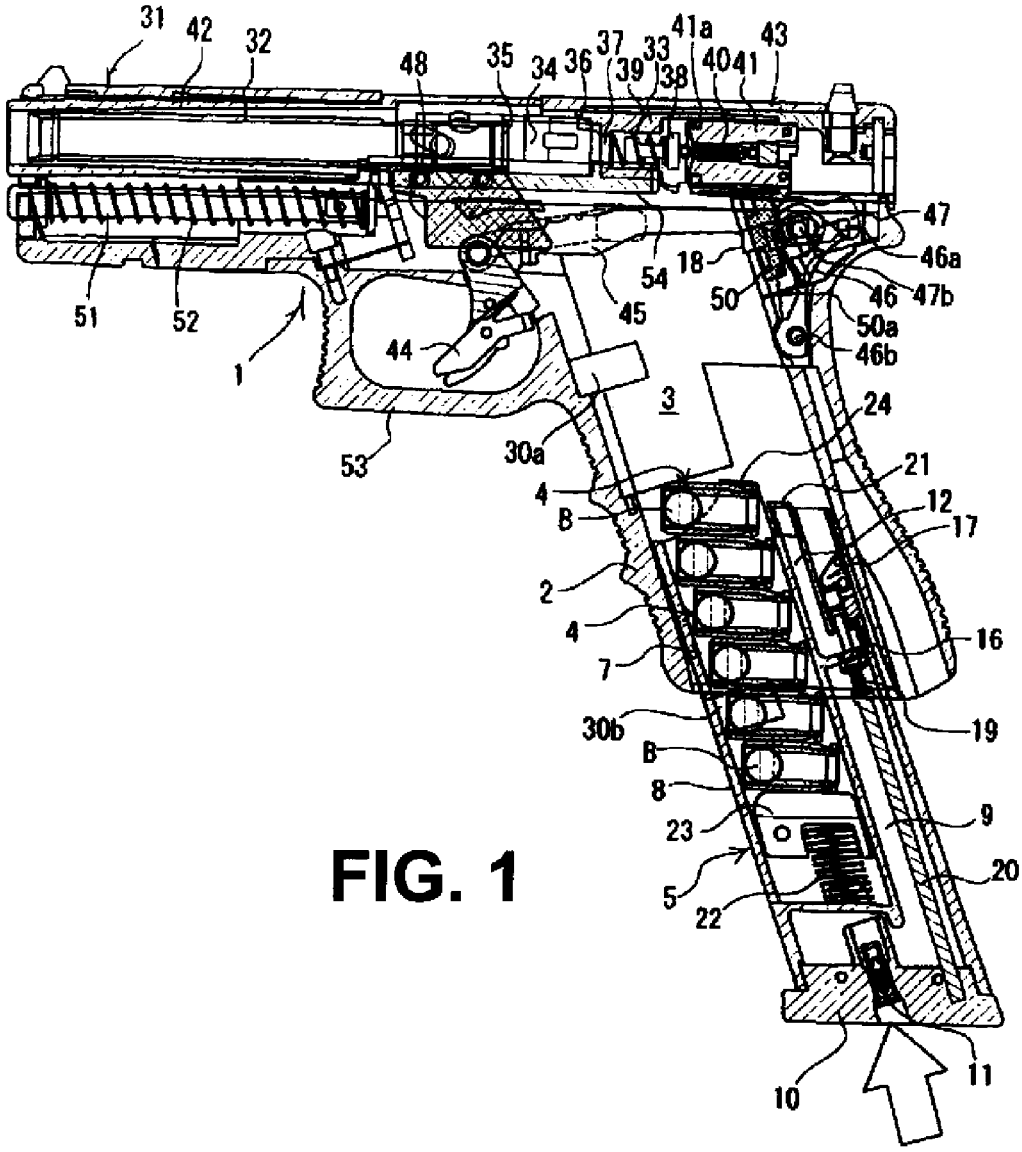
FIG. 1 is a sectional view showing the overall structure of an air gun according to the present invention, where a magazine is being loaded in a magazine chamber provided within the grip.

First, the overall structure of an air gun according to the present invention will be described. The air gun shown in FIG. 1 is one in which a magazine 5, which is separate from a gun body 1, is detachably loadable from a lower opening in a magazine chamber 3 provided in a grip 2 of the gun body 1.

Figure 2:
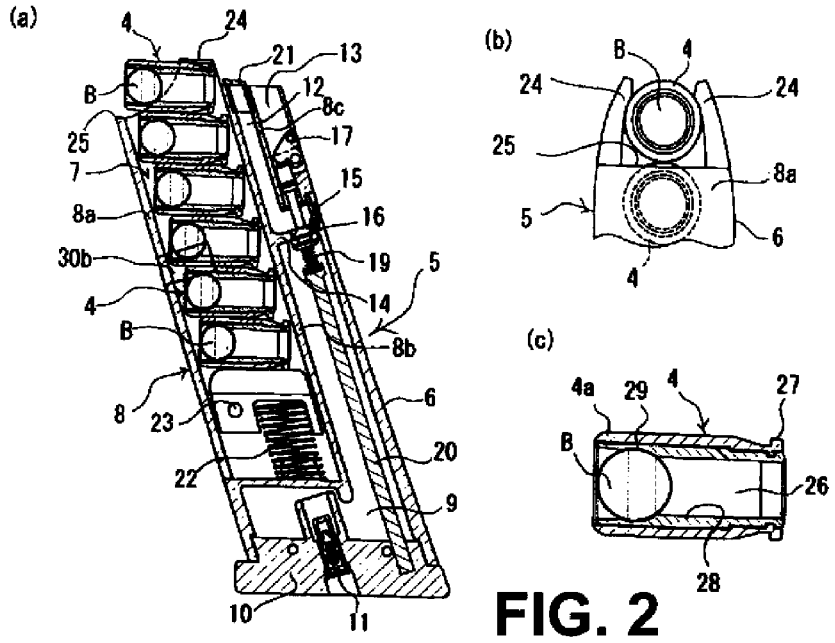
FIG. 2(*a*) is a sectional view of a magazine according to the present invention, FIG. 2(*b*) is a partially enlarged view of, as viewed from the front, magazine lips that engage with the uppermost cartridge in a clip of the magazine, and FIG. 2(*c*) is an enlarged sectional view of the cartridge.

As shown in FIG. 2(*a*), the magazine 5 comprises a clip 7 and a gas reservoir 9 that are integrally constructed in a magazine body 6. In other words, its structure is such that the clip 7 and the gas reservoir 9 are partitioned with a center boundary wall 8*b*, dividing the interior of the magazine body 6 into front and rear areas. However, the gas reservoir 9 is so formed as to wrap around under the lower portion of the clip 7. The lower open side of the gas reservoir 9 is blocked by a magazine base 10. Compressed gas can be injected into the gas reservoir 9 from a gas inlet 11 provided in the magazine base 10.

The clip 7 of the magazine 5 is provided vertically along a front wall 8*a* that forms the slope of the magazine body 6. Inside this clip 7, a follower 23 supported by a follower spring 22 is urged upward, and plural cartridges 4 are sequentially loadable above the follower 23 in a horizontally oriented fashion.

As shown in FIG. 2(*c*), each of the cartridges 4 comprises a through-hole 26 that runs through a tubular cartridge body 4*a* from front to back, and a rim 27 that protrudes from the rear end peripheral portion of the cartridge body 4*a*. An annular recess 29 which engages with, for example, a spherical plastic bullet (so-called BB bullet) B is formed near the tip of a rubber annular ring 28 that is fixated within the through-hole 26. Thus, by pushing in the bullet B from the tip side of the through-hole 26 against the resilience of the annular ring 28, it is possible to have the bullet B held in the annular recess 29.

In addition, as shown in FIGS. 2(*a*) and (*b*), the structure of the upper portion of the clip 7 of the magazine 5 is such that magazine lips 24, 24 are formed on both sides of the rear portion of an upper end opening in the clip 7, and the rear portion of the uppermost cartridge 4 in the clip 7 is engaged by these magazine lips 24, 24. Further, a notch portion 25 is formed in the upper end of the front wall 8*a* of the magazine body 6.

Here, a structure for engaging the uppermost cartridge 4 in the clip 7 of the magazine 5 and for transferring this cartridge 4 to a later-described chamber 34 will be described. As shown in FIGS. 2(*a*) and (*b*), the magazine lips 24, 24 that engage with the rear portion of the uppermost cartridge 4 in the clip 7 are provided on both sides of the rear portion of the upper end opening in the clip 7 of the magazine 5 as mentioned above. In addition, the notch portion 25 is formed in the upper end of the front wall 8*a* of the magazine body 6. This notch portion 25 has such a depth that allows for forward movement of the uppermost cartridge 4 in the clip 7.

Figure 14:
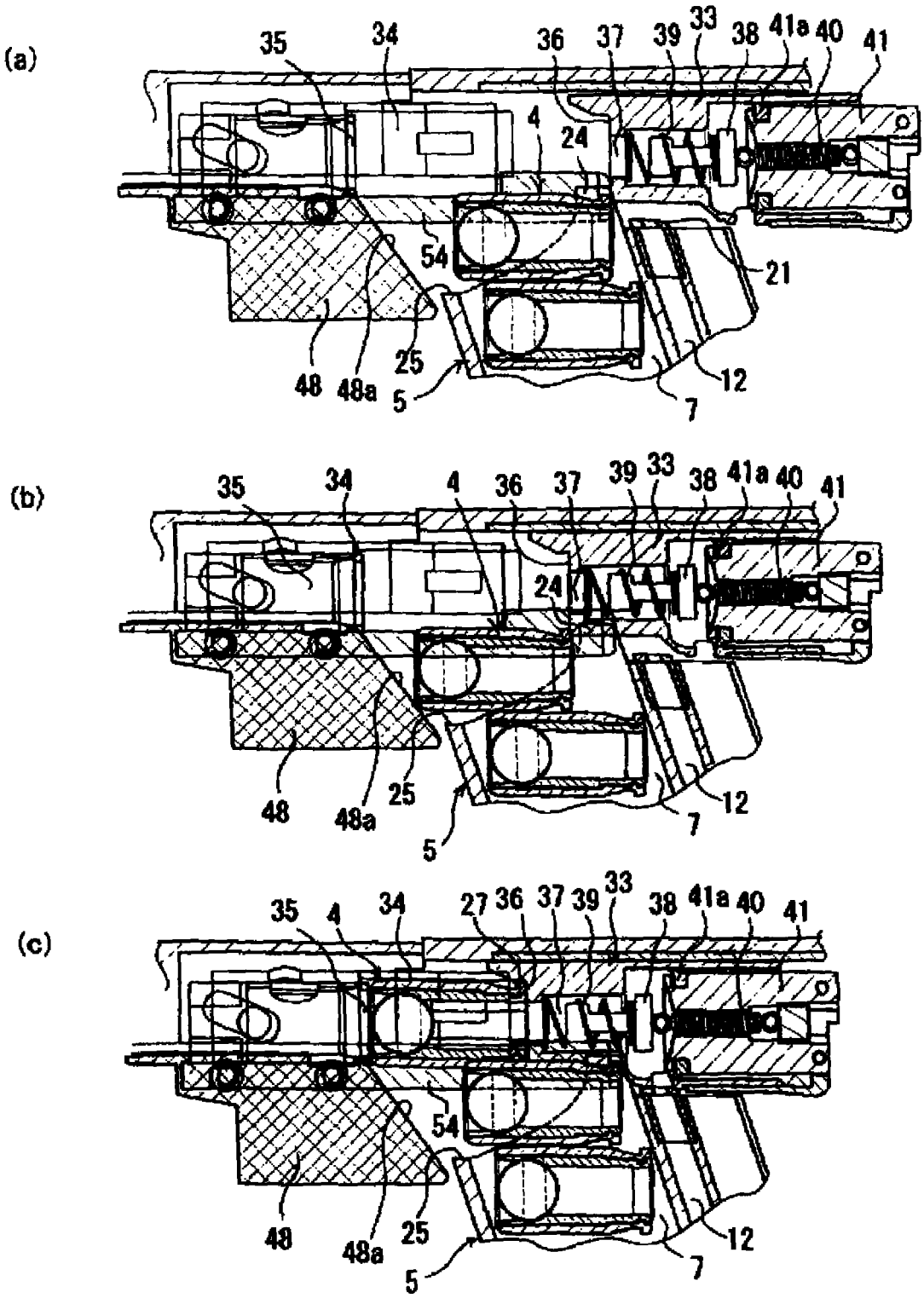
FIGS. 14(*a*)-(*c*) are partially enlarged sectional views showing an operation for loading in the chamber the uppermost cartridge in a clip of a magazine according to the present invention.

Further, as shown in FIGS. 14(*a*)-(*c*), the magazine lips 24 are formed in such a length that the engaging action with respect to the uppermost cartridge 4 in the clip 7 is released at a position where, having moved forward, the front end of the cartridge 4 is in contact with an inclined guiding surface 48*a* of a feeding ramp 48 provided at a forward position relative to the magazine 5.

By virtue of such a structure, the uppermost cartridge 4 in the clip 7 shown in FIG. 14(*a*) is engaged by the magazine lips 24, 24 (see FIG. 2(*b*)), and the uppermost cartridge 4 in the clip 7 is pushed out forward by a forward movement of a cylinder 33. Next, as shown in FIG. 14(*b*), at a position where the front end of the cartridge 4 is in contact with the inclined guiding surface 48*a* of the feeding ramp 48, the cartridge 4 is released from the engaging action by the magazine lips 24, 24. At this point, since the cartridges 4 housed in the clip 7 are supported from below by the follower 23 and urged upward by the follower spring 24, the uppermost cartridge 4 is pushed upward at once, hits the ceiling surface of the chamber 34 in a substantially parallel manner, and is loaded in the chamber 34 in a stable posture as shown in FIG. 14(*c*).

Further, as shown in FIG. 2(*a*), a gas discharge channel 12 separated by a boundary wall 14 is provided above the gas reservoir 9, and a link chamber 13 separated by a rear boundary wall 8*c* is provided to the rear of this gas discharge channel 12. In such a structure, the upper end portion of a discharge valve 16 that opens/closes a gas discharge hole 15 formed in the boundary wall 14 is engaged by a valve link 17 that is pivotally supported in the link chamber 13 so as to be rotatable. Further, since the lower end of the discharge valve 16 supported by a rod-shaped valve base 20 via a valve spring 19, the discharge valve 16 is constantly urged upward, thereby closing the gas discharge hole 15 under ordinary circumstances. When the valve link 17 rotates due to actuation of a later-described valve hammer 18 that is provided in the gun body 1, the discharge valve 16 is actuated downward, and the gas discharge hole 15 is opened.

It is noted that a nozzle rubber 21 is provided at the upper end portion of the gas discharge channel 12. As will be described later, when the magazine 5 is loaded in the magazine chamber 3, the nozzle rubber 21 adheres closely to the body side, thereby making it possible to maintain the gas discharge channel 12 airtight.

Next, the structure of the gun body 1 will be described. In FIG. 1, the structure is such that the magazine chamber 3, in which the magazine 5 is to be detachably loaded in the grip 2 of the gun body 1, has its lower side open. The magazine 5 can be loaded in this magazine chamber 3 by being pushed therein. A magazine catch 30*a* provided partway up the magazine chamber 3 functions as a stopper that fixates the magazine 5 inserted into the magazine chamber 3 at a given position by engaging with a catch receiver 30*b* provided on a side portion of a magazine case 8. Further, by pushing the magazine catch 30*a* in, this stopper function can be released and the magazine 5 can be pulled out from the magazine chamber 3.

As shown in FIG. 1, a thin tubular inner barrel 32 is fixated in a barrel 31 at the upper portion of the gun body 1. The chamber 34 is provided between this inner barrel 32 and the cylinder 33 provided to the rear thereof. This chamber 34 comprises a space formed rearward of a cartridge holding recess 35 provided at the rear end of the inner barrel 32. Thus, the cartridge 4 that is fed from the clip 7 of the magazine 5 is loaded in the chamber 34, that is, the cartridge holding recess 35 at the rear end of the inner barrel 32, by being guided by the inclined guiding surface 48*a* of the feeding ramp 48 as mentioned above. Further, the rear end of the cartridge 4 is held by a bolt face 36 at the front end of the cylinder 33 (see FIG. 6).

Figure 12:
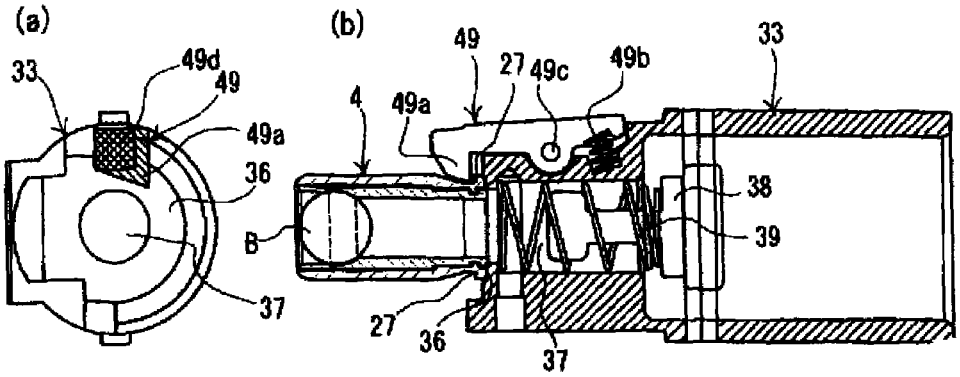
FIGS. 12(*a*) and 12(*b*) are diagrams showing a state in which an extractor according to the present invention is attached to the cylinder, where FIG. 12(*a*) is an end view showing the bolt face of the cylinder and FIG. 12(*b*) is a sectional view of the cylinder.

The cartridge 4 thus loaded in the chamber 34 is held at a given position in the chamber 34 by having the rim 27 formed at the rear end of the cartridge 4 engaged by a claw portion 49*a* of an extractor 49 latched to the cylinder 33 (see FIG. 12).

Here, the extractor 49 in the present embodiment will be described. As shown in FIGS. 12(*a*) and (*b*), the extractor 49, which engages with the rim 27 formed at the rear end of the cartridge 4 loaded in the chamber 34 (see FIGS. 13, 14, etc.), is pivotally provided on a side portion of the cylinder 33 in a freely rotatably manner by means of a pivot 49*c*. Further, through the urging force of a spring 49*b* provided between the extractor 49 and the cylinder 33, it becomes possible to cause the claw portion 49*a* formed at the tip of the extractor 49 to engage the rim 27 of the cartridge 4.

As shown in FIG. 12(*a*), unlike a conventional claw portion 49*d* with a square cross-section, the claw portion 49*a* of this extractor 49 has a tapering sloped shape, and is capable of making the cartridge 4 loadable in the chamber 34 even in cases where the distance from the front end of the cartridge 4 to the chamber 34 is short.

Further, as a slide 43 moves rearward while the cartridge 4 is held within the chamber 34, and as the cylinder 33 moves rearward with the stopping of the supply of compressed gas from the gas reservoir 9, the cartridge 4 comes into contact with an ejector 54 and is ejected from the chamber 34.

By having, through such a structure, the extractor 49 latched to the cylinder 33 that is movable relative to the slide 43, the cartridge 4 is held in the chamber 34 in a state where it is engaged by the extractor 49 latched to the cylinder 33. As a result, it becomes possible for the slide 43 to move rearward during a blowback operation.

In addition, the ejector 54 is fixated to the gun body below the chamber 34, and as the cartridge 4 loaded in the chamber 34 moves rearward, the cartridge 4 comes into contact with the ejector 54. Consequently, the engagement by the claw portion 49*a* of the extractor 49 with respect to the rim 27 of the cartridge 4 is released, the cartridge 4 is kicked up by the urging force of the follower spring 22 from below, and the cartridge 4 is thereby ejected.

Further, as shown in FIG. 1, there is formed at the front portion within the cylinder 33 a penetrating cylinder channel 37 that communicates with the chamber 34. A nozzle spoiler 38 that opens/closes the cylinder channel 37 is provided at the rear end of this cylinder channel 37 with a nozzle spring 39 placed in-between. The nozzle spoiler 38 is urged in, by means of the elastic force of the nozzle spring 39, in such a direction as to open the cylinder channel 37.

In addition, a piston 41 that moves inside the cylinder 33 is fixated to the interior of the rear end of the slide 43. This piston 41 and the nozzle spoiler 38 are linked with a return spring 40. However, under normal circumstances, the nozzle spoiler 38 is, by means of the elastic force of the nozzle spring 39, placed in a state where it has the cylinder channel 37 open. As will be described later, when the nozzle spoiler 38 is pressed forward by the pressure of the compressed gas that is fed from the gas reservoir 9, the cylinder channel 37 is blocked.

Figure 13:
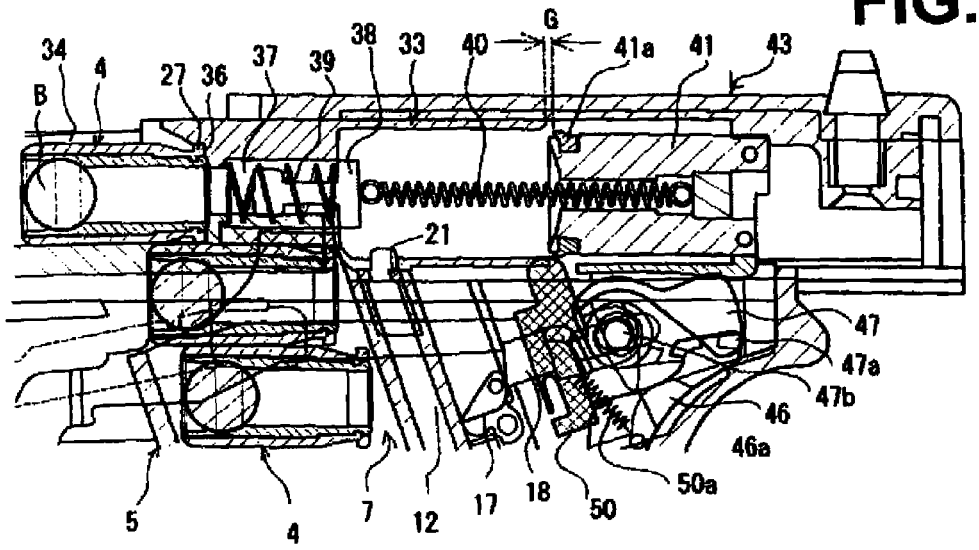
FIG. 13 is a sectional view showing the gap between the rear end of a cylinder according to the present invention and a rubber packing provided on the outer circumference of the front end of a piston.

As the nozzle spoiler 38 thus blocks the cylinder channel 37, the interior of the cylinder 33 becomes sealed. Once the interior of this cylinder 33 becomes completely sealed, the compressed gas inside the cylinder 33 backflows into the gas discharge channel 12. For this reason, it had been conventional to provide a gap of about 0.5 mm between the rear end of the cylinder 33 and a rubber packing 41*a* provided on the outer circumference of the front end of the piston 41, and to thus discharge through this gap the compressed gas filling the cylinder 33. However, the blowback operation of the slide 43 cannot be performed quickly with a gap of such a size. Therefore, as shown in FIG. 13, in the present embodiment, a gap G of at least 1 mm is provided between the rear end of the cylinder 33 and the rubber packing 41*a* on the outer circumference of the front end of the piston 41, and the compressed gas inside the cylinder 33 is thus discharged at once through this gap G.

On the other hand, an outer barrel 42 is provided on the outer circumference of the inner barrel 32. The slide 43 is provided on the outer circumference of the outer barrel 42 in such a manner as to be movable forward and rearward. A recoil spring 52, which elastically urges the slide 43 forward as the slide 43 moves rearward, is provided on the circumferential portion of a recoil guide 51 provided below the barrel 31. The piston 41 is fixated at a given position inside the rear portion of the slide 43. Thus, while the piston 41 moves with the forward/rearward movement of the slide 43, the cylinder 33 is movable forward and rearward inside the slide 43.

Further, as shown in FIG. 1, a trigger 44 is pivotally supported on a frame 53 of the gun body 1. Via a trigger bar 45, the trigger 44 is linked to a sear 46 provided at a rear portion of the gun body 1. The sear 46 is so provided as to be freely rotatable by means of a sear shaft 46*b* provided at the lower end thereof, and is urged anti-clockwise in the drawing by means of a sear spring (not shown) provided around the sear shaft 46*b*. A claw portion 46*a* formed at the upper portion of the sear 46 is so configured as to engage and disengage with and from a sear engaging portion 47*a* of a hammer 47. The hammer 47 is so urged as to rotate anti-clockwise in the drawing by means of a hammer spring (not shown) provided on a hammer shaft 47*b*.

Figure 4:
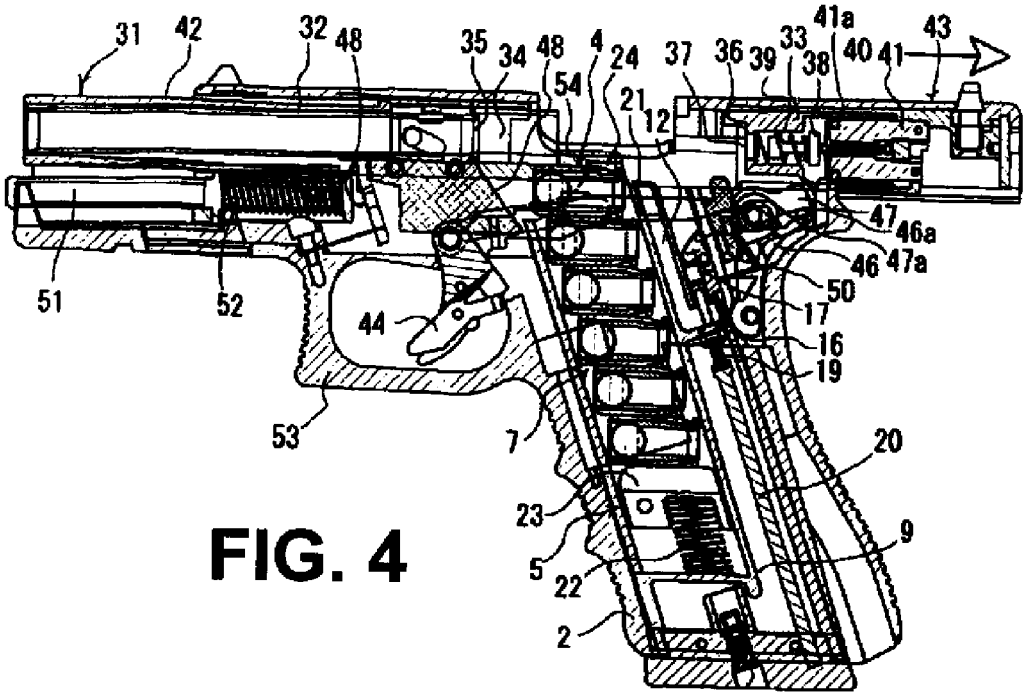
FIG. 4 is a sectional view showing a state where the slide of an air gun according to the present invention is moving rearward.

The valve hammer 18 is so fitted as to be slidable relative to the hammer shaft 47*b*. By means of a spring member (not shown) that pulls the valve hammer 18 towards the sear 46, the tip side of the valve hammer 18 is urged towards below the magazine chamber 3. As shown in FIG. 4, this valve hammer 18 engages the upper side of the valve link 17 of the magazine 5 that is loaded in the magazine chamber 3. By having the valve hammer 18 move forward/backward due to actuation of the hammer 47, the valve link 17 can be rotated or restricted.

Further, a valve lock 50 is constantly urged upward by a valve lock spring 50*a*. The upper end of this valve lock 50 engages with a bottom portion of the slide 43, and as the valve lock 50 is pushed down along with the rearward movement of the slide 43, the valve hammer 18 is placed in a locked state due to the downward movement of this valve lock 50. A state where the valve link 17 is pushed down, that is, a state where the discharge valve 16 is pushed down to open the gas discharge hole 15, is thus maintained. Further, as the valve lock 50 moves upward due to a forward movement of the slide 43, the valve hammer 18 is released from the locked state, and the discharge valve 16 moves upward due to the spring force of the valve spring 19, thereby closing the gas discharge hole 15.

Figure 3:
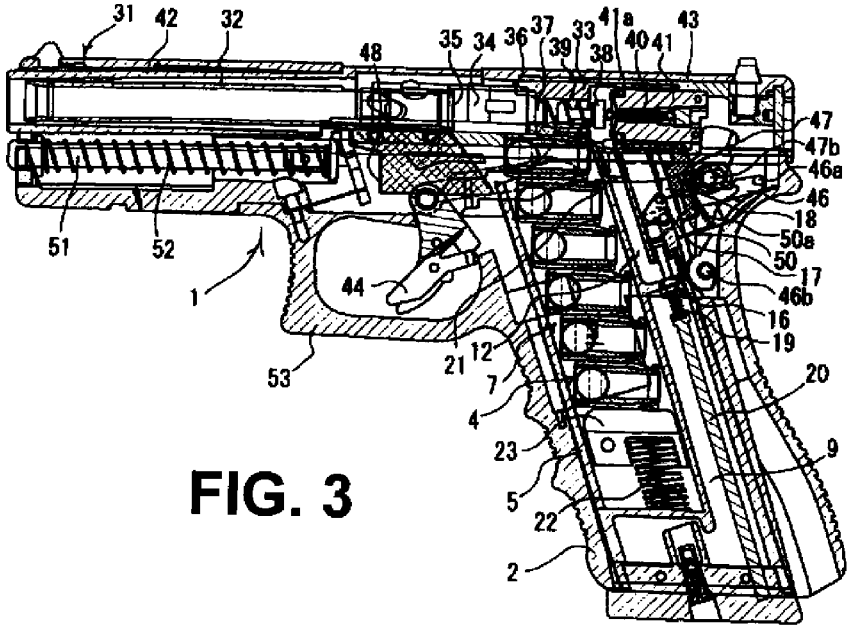
FIG. 3 shows an air gun according to the present invention where a magazine is loaded in a magazine chamber provided in the grip.

Next, operations of an air gun having the structure mentioned above will be described. By pushing, from below, the magazine 5 into the magazine chamber 3 of the grip 2 shown in FIG. 1, the magazine-loaded state shown in FIG. 3 is created. At this point, by having the nozzle rubber 21 of the magazine 5 fitted into a nozzle receiver of the gun body 1, the gas discharge channel 12 and the interior of the cylinder 33 are placed in a communicating state while maintaining the gas discharge channel 12 airtight.

Next, as shown in FIG. 4, when the slide 43 is pulled rearward against the elastic force of the recoil spring 52, the rear end of the slide 43 hits the hammer 47, thereby cocking the hammer 47. At this point, the sear engaging portion 47*a* of the hammer 47 is engaged by the claw portion 46*a* of the sear 46, as a result of which the hammer 47 maintains its cocked state.

Figure 5:
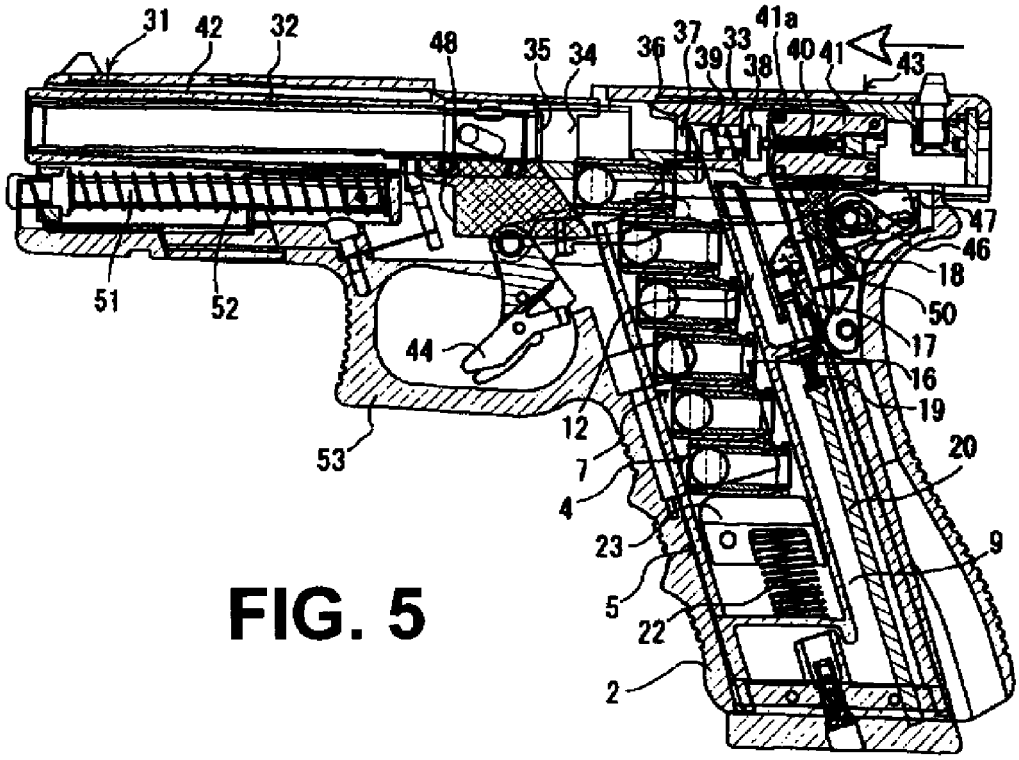
FIG. 5 is a sectional view showing a state where the slide of an air gun according to the present invention is returning forward.
Figure 6:
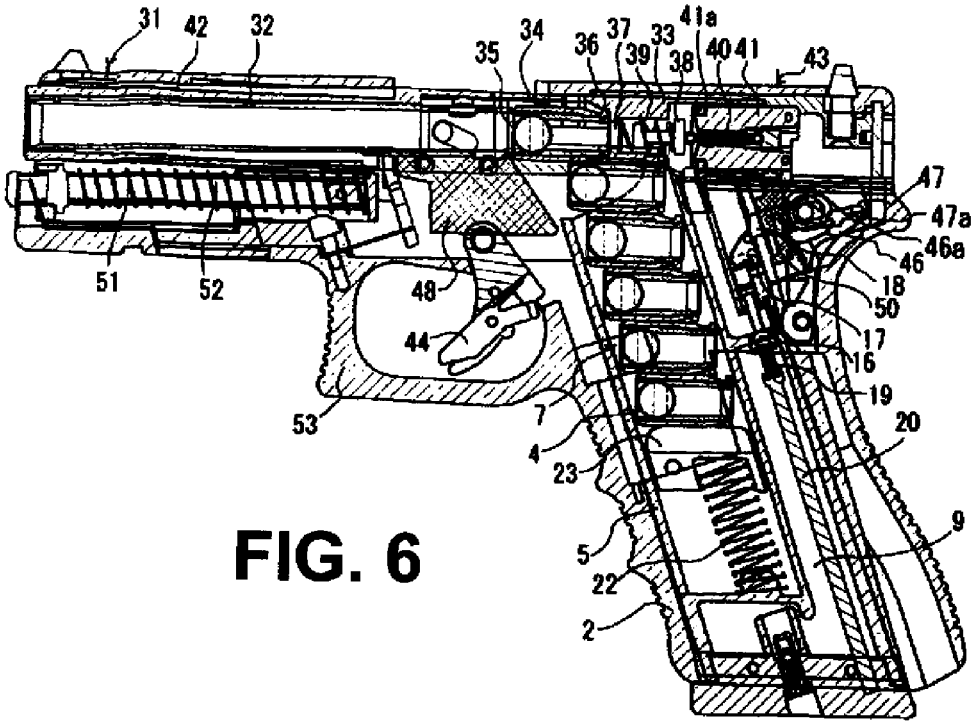
FIG. 6 is a sectional view showing a state where a cartridge inside a clip has been loaded in a chamber in the body of an air gun according to the present invention.

Next, as shown in FIG. 5, when the slide 43 is let go from a state where it is pulled rearward, the slide 43 returns forward due to the elastic force of the compressed recoil spring 52. Further, during the time it takes for the slide 43 to return completely, as was described above with reference to FIGS. 14(*a*)-(*c*), the uppermost cartridge 4 in the clip 7 moves to the chamber 34 and enters a state where it is loaded in the chamber 34 as shown in FIG. 6. At this point, the outer circumference of the front end of the cartridge 4 is engaged by the cartridge holding recess 35 at the rear end of the inner barrel 32, while at the same time the rear end of the cartridge 4 engages with the bolt face 36 at the front end of the cylinder 33. The cartridge 4 is thus placed in a state where it is held within the chamber 34.

Figure 7:
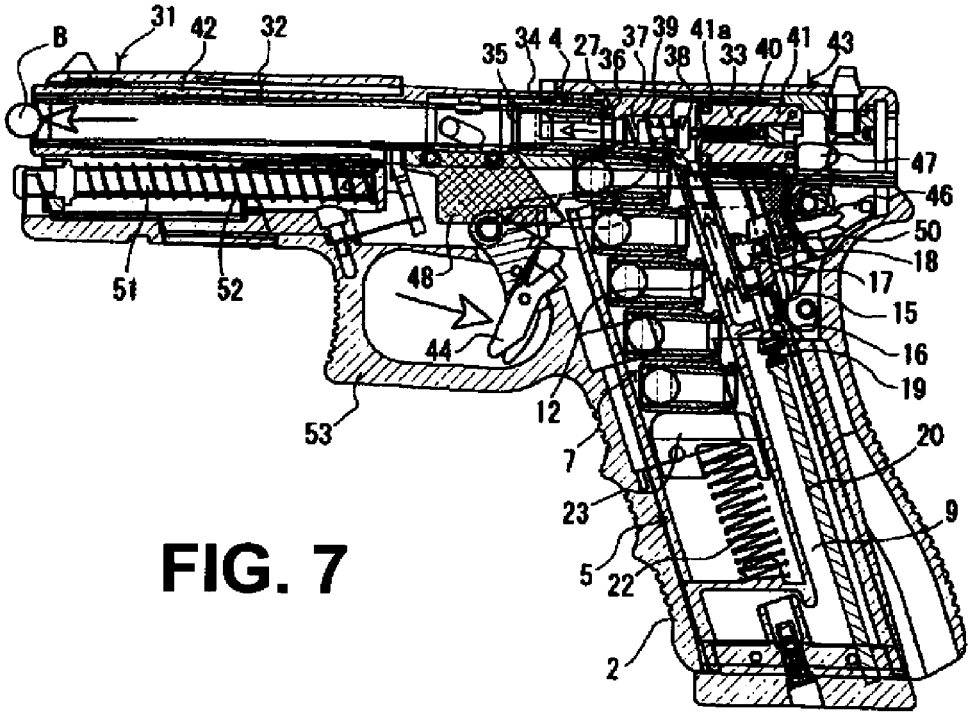
FIG. 7 is a sectional view of an air gun according to the present invention shown in a state where the trigger is pulled and a bullet inside a cartridge is being fired.

Next, once the trigger 44 is pulled to its rearmost position as shown in FIG. 7, the sear 46 rotates due to actuation of the trigger bar 45 (see FIG. 1), the sear engaging portion 47*a* of the hammer 47, which was engaged by the claw portion 46*a* of the sear 46 in FIG. 6, is disengaged, and the hammer 47 rotates anti-clockwise in the drawing due to the elastic force of the hammer spring (not shown). Further, as the hammer 47 rotates and the valve hammer 18 moves forward, the valve link 17 rotates. Once the discharge valve 16 is consequently pushed downward and the gas discharge hole 15 is placed in an open state, the compressed gas of the gas reservoir 9 passes through the gas discharge channel 12 from the gas discharge hole 15 and reaches the rear portion of the chamber 34 via the cylinder channel 37, which is in an open state. Further, the compressed gas passes through the inside of the through-hole 26 in the cartridge 4 and applies pressure on the bullet B from behind, thereby firing the bullet B forward.

Figure 8:
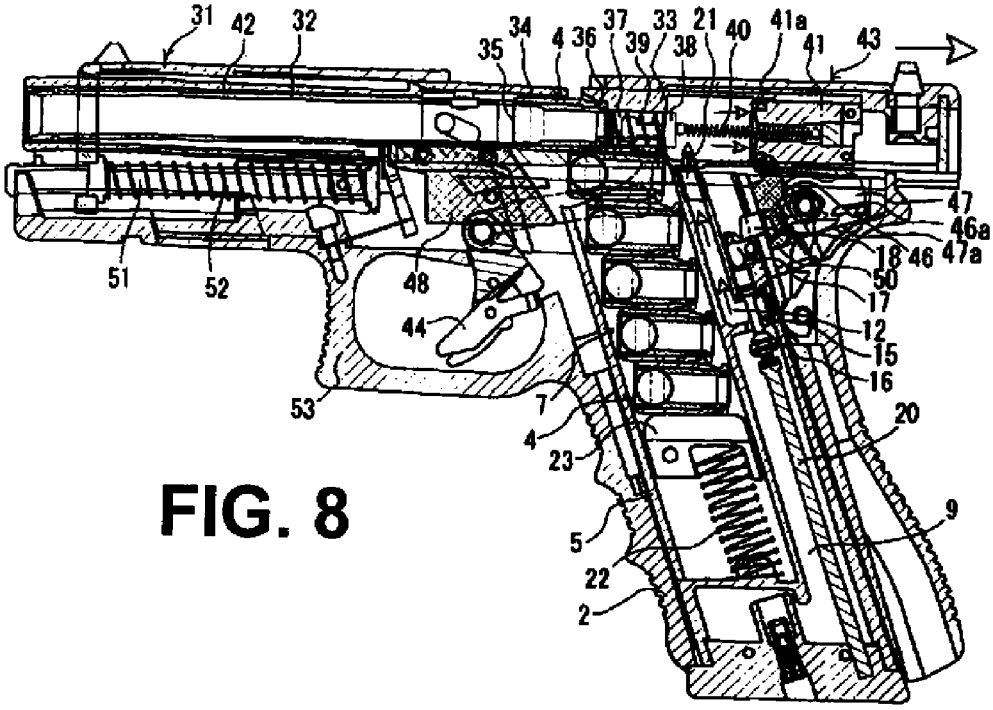
FIG. 8 is a sectional view of an air gun according to the present invention shown in a state where the slide is moving rearward after a bullet has been fired.

Next, as shown in FIG. 8, after the bullet B has been fired, because the gas discharge hole 15 maintains its open state, the compressed gas from the gas reservoir 9 continues to be discharged into the gas discharge channel 12, and the nozzle spoiler 38 is pushed forward, thereby blocking the cylinder channel 37. Consequently, the interior of the cylinder 33 is filled with the compressed gas, and the piston 41 is pressured rearward.

As the slide 43 thus begins to move rearward, the rear end of the slide 43 again pushes the hammer 47 rearward to cock the hammer 47, and the sear engaging portion 47*a* of the hammer 47 engages with the claw portion 46*a* of the sear 46 to maintain a state in which the hammer 47 is cocked.

Figure 9:
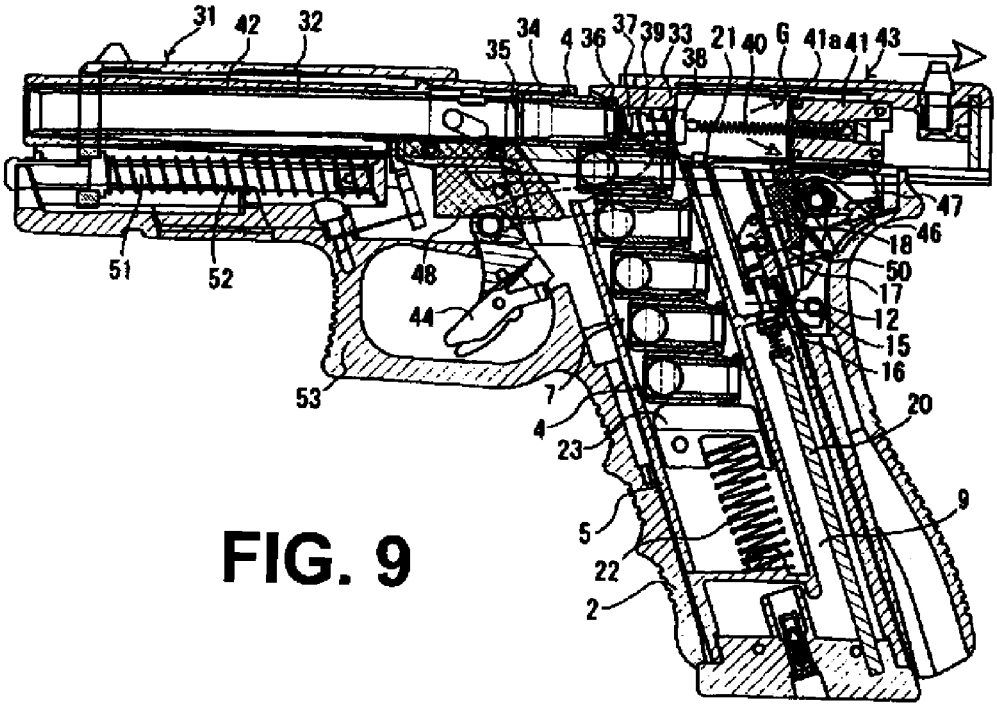
FIG. 9 is a sectional view of an air gun according to the present invention shown in a state where the supply of compressed gas into the cylinder is stopped, while at the same time the compressed gas within the cylinder is being discharged.

Further, as shown in FIG. 9, as the valve lock 50 moves downward due to the rearward movement of the slide 43, the valve hammer 18 moves rearward. Once the valve link 17 is consequently released to become rotatable, the discharge valve 16 moves upward due to the elastic force of the valve spring 19, the gas discharge hole 15 is blocked, and the discharging of the compressed gas from the gas reservoir 9 is thus stopped.

Figure 10:
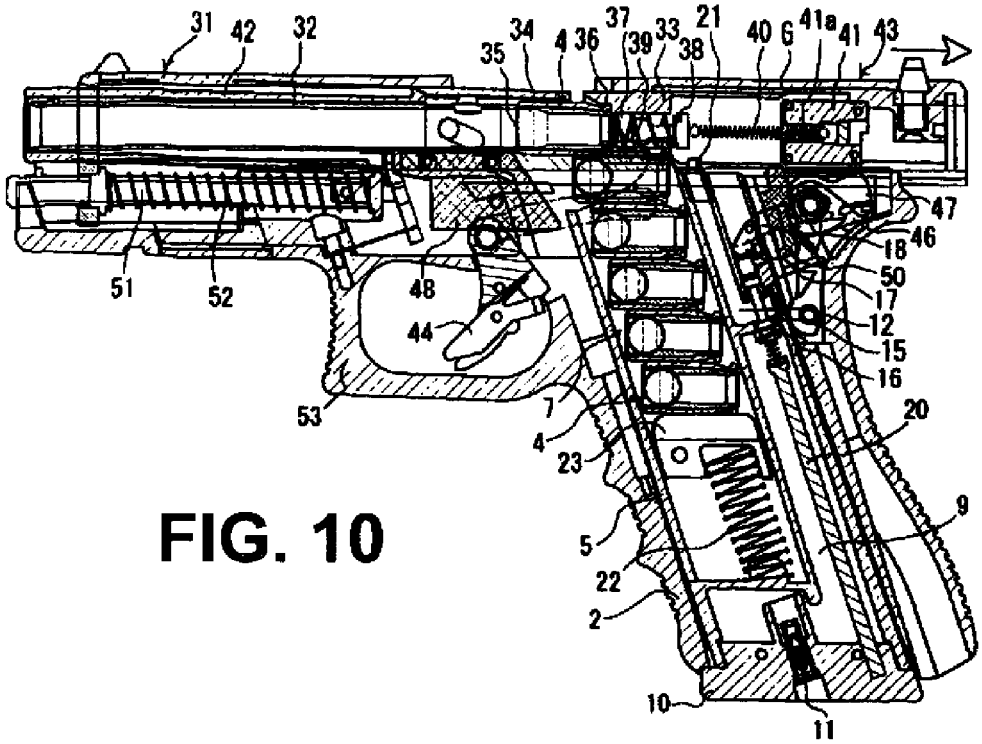
FIG. 10 is a sectional view of an air gun according to the present invention shown in a state where, after the compressed gas inside the cylinder has been discharged, a nozzle spoiler is being pulled rearward by a return spring.
Figure 11:
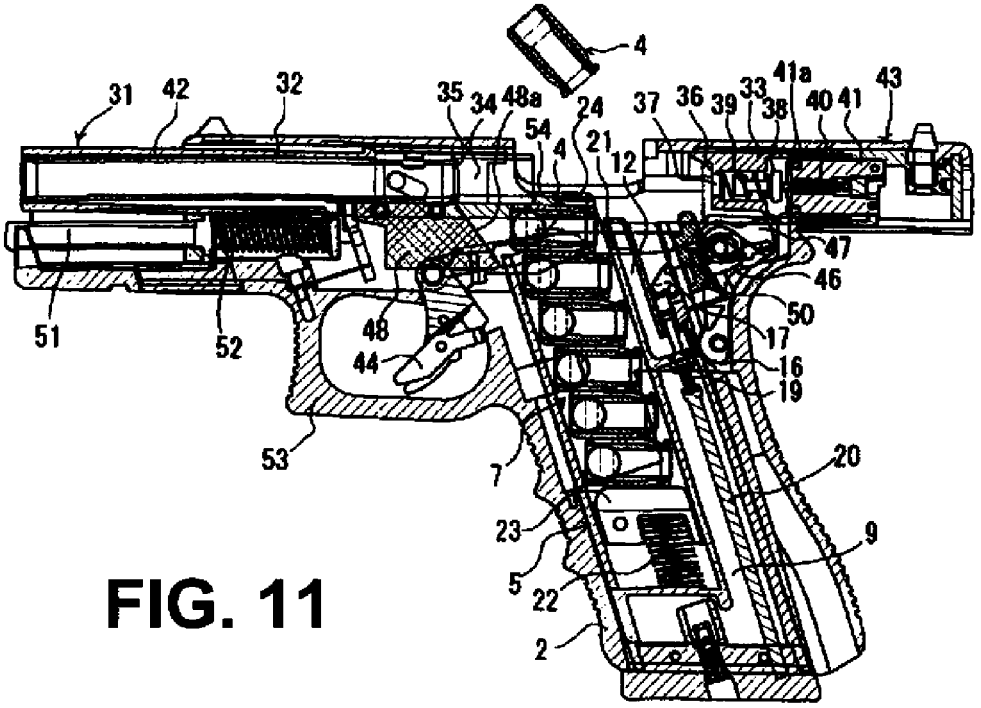
FIG. 11 is a sectional view of an air gun according to the present invention shown in a state where, after a bullet has been fired, the slide moves rearward and a spent cartridge is ejected.

At this point, as shown in FIG. 9, the compressed gas that fills the interior of the cylinder 33 is discharged at once from the gap G of at least 1 mm provided between the rear end of the cylinder 33 and the rubber packing 41*a* on the outer circumference of the front end of the piston 41. As a result, as shown in FIG. 10, the gas pressure inside the cylinder 33 is lost and the nozzle spoiler 38 is pulled rearward by the return spring 40, thereby opening the channel 37 of the cylinder 33 while also moving the cylinder 33 rearward. Consequently, the time at which the cylinder 33 moves rearward is advanced, thereby making it possible to perform the rearward movement operation (blowback operation) of the slide 43 quickly.

Further, due to the above-mentioned rearward movement of the slide 43, the cartridge inside the chamber comes into contact with the ejector and is subjected to the kicking action of the ejector 54. As a result, the rim 27 of the cartridge 4 (see FIG. 12) is released from the engagement by the extractor 49, while at the same time the uppermost cartridge 4 in the clip 7 is pushed out upward due to the elastic force of the follower spring 22. Consequently, the spent cartridge 4 inside the chamber 34 is ejected outside.

Thereafter, it operates as in FIG. 5. In other words, in conjunction with the returning forward of the slide 43, the uppermost cartridge 4 in the clip 7 is pushed in the direction of the chamber 34 due to the rearward movement of the cylinder and is placed in a state where it is loaded in the chamber 34. The next firing is thus prepared for, and thereafter, it becomes possible to successively fire bullets and eject cartridges without having to manually move the slide 43 rearward.

INDUSTRIAL APPLICABILITY

An air gun according to the present invention is applicable as a cartridge-based air gun that fires a BB bullet or resin bullet inside a cartridge using compressed gas, the cartridge-based air gun comprising an engaging structure of an extractor that enables blowback and automatic ejection of the cartridge. In addition, the present invention is applicable as a cartridge-based air gun that enables a faster blowback operation. Further, the present invention is applicable as a cartridge-based air gun in which an operation for loading a cartridge from a clip of a magazine into a chamber is performed smoothly and reliably.

REFERENCE SIGNS LIST

B bullet
G gap
1 gun body
2 grip
3 magazine chamber
4 cartridge
4*a* cartridge body
5 magazine
6 magazine body
7 clip
8 magazine case
8*a* front wall
8*b* center boundary wall
8*c* rear boundary wall
9 gas reservoir
10 magazine base
11 gas inlet
12 gas discharge channel
13 link chamber
14 boundary wall
15 gas discharge hole
16 discharge valve
17 valve link
18 valve hammer
19 valve spring
20 valve base
21 nozzle rubber
22 follower spring
23 follower
24 magazine lip
25 notch portion
26 through-hole
27 rim
28 annular ring
29 annular recess
30*a* magazine catch
30*b* catch receiver
31 barrel
32 inner barrel
33 cylinder
34 chamber
35 cartridge holding recess
36 bolt face
37 cylinder channel
38 nozzle spoiler
39 nozzle spring
40 return spring

41 piston
41*a* rubber packing
42 outer barrel
43 slide
44 trigger
45 trigger bar
46 sear
46*a* claw portion
46*b* sear shaft
47 hammer
47*a* sear engaging portion
47*b* hammer shaft
48 feeding ramp
48*a* inclined guiding surface
49 extractor
49*a* claw portion
49*b* spring
49*d* conventional claw portion with a square cross-section
50 valve lock
50*a* valve lock spring
51 recoil guide
52 recoil spring
53 frame
54 ejector

What is claimed is:

1. A cartridge-based air gun comprising:

a clip, which vertically loaded with plural cartridges that are each horizontally oriented, and a gas reservoir provided inside a magazine that is provided separately from a body of the gun, the magazine detachably loaded in a magazine chamber provided in a grip of the body of the gun;

a chamber provided between a rear end of an inner barrel, which is provided in a barrel of the body of the gun, and a front end of a cylinder, which is so provided as to be movable forward and rearward inside a slide that is capable of moving forward and rearward on an outer circumference of the inner barrel;

an uppermost cartridge in the clip in the magazine loadable to the chamber by being urged by a spring force of a follower spring provided within the clip;

each of the plural cartridges configured as to hold a bullet in a through-hole provided therein and to be friable forward by compressed gas that is supplied from behind;

wherein after the bullet loaded in the cartridge is fired by the compressed gas supplied from the gas reservoir, a spent cartridge is automatically ejected when the slide automatically moves rearward due to the compressed gas that fills the cylinder;

an extractor that engages with a rim, which is formed at a rear end of the cartridge loaded in the chamber, pivotally provided on a side portion of the cylinder so as to be rotatable, and a claw portion formed at a tip of the extractor able to engage with the rim of the cartridge by means of an urging force of a spring provided between the extractor and the cylinder, wherein as the slide moves rearward while the cartridge is held inside the chamber and as the cylinder moves rearward with the stopping of the supply of the compressed gas from the gas reservoir, the cartridge comes into contact with the ejector and is ejected from the chamber, and wherein by providing a gap of at least 1 mm between a rear end of the cylinder and a rubber packing provided on an outer circumference of a front end of a piston, blowback of the slide is performed quickly by discharging at once through the gap the gas that fills the cylinder.

2. The cartridge-based air gun according to claim 1, wherein, magazine lips that engage with a rear portion of the uppermost cartridge in the clip are provided on both sides at a rear portion of an upper end opening in the clip in the magazine;

a notch portion is formed in an upper end of a front wall of a body of the magazine;

the notch portion has such a depth that makes it possible for the uppermost cartridge in the clip to move forward; and the magazine lips are formed in such a length that an engaging action with respect to the uppermost cartridge in the clip is released at a position where, having moved forward, a front end of the cartridge is in contact with an inclined guiding surface of a feeding ramp provided at a forward position relative to the magazine.

* * * * *